US006957674B2

(12) United States Patent
Burr

(10) Patent No.: US 6,957,674 B2
(45) Date of Patent: Oct. 25, 2005

(54) LOCKING FUEL NOZZLE

(76) Inventor: Joe A. Burr, 621 W. Main St., Boomville, AR (US) 72927

( * ) Notice: Subject to any disclaimer, the term of this patent is extended or adjusted under 35 U.S.C. 154(b) by 106 days.

(21) Appl. No.: 10/751,640

(22) Filed: Jan. 6, 2004

(65) Prior Publication Data

US 2005/0145296 A1 Jul. 7, 2005

(51) Int. Cl.[7] ..... B65B 1/04
(52) U.S. Cl. ..... 141/386; 141/392
(58) Field of Search ..... 141/59, 392, 206–226, 141/383–386; 285/235–237, 382.4–382.7

(56) References Cited

U.S. PATENT DOCUMENTS

| | | | | |
|---|---|---|---|---|
| 3,566,928 A | | 3/1971 | Hansel | |
| 3,604,478 A | * | 9/1971 | Gowens | 141/59 |
| 3,805,857 A | | 4/1974 | Johnson et al. | |
| 3,845,792 A | | 11/1974 | Johnson | |
| 3,989,072 A | | 11/1976 | Voelz et al. | |
| 3,990,490 A | | 11/1976 | Voelz | |
| 4,505,308 A | | 3/1985 | Walker et al. | |
| 4,898,395 A | | 2/1990 | Kawase | |
| 5,333,653 A | * | 8/1994 | Rzesutock et al. | 141/1 |
| 5,609,192 A | | 3/1997 | Anderson et al. | |
| 5,655,577 A | | 8/1997 | Loen et al. | |
| 6,026,866 A | | 2/2000 | Nanaji | |
| 6,079,581 A | | 6/2000 | Hashimoto et al. | |
| 6,095,207 A | | 8/2000 | Enders et al. | |
| 6,276,405 B1 | * | 8/2001 | Wang | 141/38 |

FOREIGN PATENT DOCUMENTS

| | | |
|---|---|---|
| GB | 2 053 129 | 2/1981 |

* cited by examiner

*Primary Examiner*—Steven O. Douglas
(74) *Attorney, Agent, or Firm*—Richard C. Litman

(57) ABSTRACT

The locking fuel nozzle is used to prevent spilling of fuel while filling two-inch fill tubes on railroad cars. The nozzle includes a nozzle tube that is secured to a pressurized fuel source. The nozzle tube is inserted into the opening of the fill tube and delivers fuel from the pressurized fuel source to a fuel receptacle. A sealing member is disposed along the nozzle tube. A compression member is slidably disposed along the nozzle for impacting the sealing member. A handle is secured to the compression member for forcing the compression member along the nozzle tube. The compression member compresses the sealing member forcing it to swell. The sealing member swells until it completely seals the opening of the fill tube and the compression member is then locked into place by the handle.

18 Claims, 4 Drawing Sheets

LOCKING FUEL NOZZLE

BACKGROUND OF THE INVENTION

1. Field of the Invention

The present invention relates to fuel nozzles and more particularly to a locking, automatic shut-off, non-spilling fuel nozzle for supplying fuel to railroad cars or other similar fuel tanks.

2. Description of the Related Art

Railroad train cars typically have a two inch fill tube for receiving fuel into its fuel tank. Two inch fill tubes are filling pipes having a two inch, threaded outer diameter. When supplying fuel to a fuel tank through the two inch fill tube a nozzle or other fitting must be screwed onto the threaded end of the filling tube. Over time the threads on the filling tube wear down or become damaged. When this occurs the connection between the fuel delivering nozzle and the filling tube becomes less secure and fuel will begin to leak during filling. The following patent documents disclose fuel delivery nozzles providing different means for preventing fuel leakage during filling.

United Kingdom Patent number GB 2 053 129 published on Feb. 4, 1981 discloses an apparatus for transferring fluent solids, liquids or gases to receptacles or pipelines. The apparatus comprises a discharge conduit associated with an inflatable member into which fluid can be introduced to cause it to expand into sealing contact with a mouth of a receptacle. The seal prevents escape of dust and fumes while allowing a range of sizes of receptacles to be used.

U.S. Pat. No. 6,095,207 issued on Aug. 1, 2000 to Enders discloses sealing device for a filling opening and method for its control. The sealing device is designed to prevent leakage of fuel fumes when filling a fuel tank. The seal is located in the vicinity of the filling opening inside of the fuel receiving container and abuts in a sealing fashion an object such as a filling device that is inserted into the filling opening.

U.S. Pat. No. 6,079,581 issued on Jun. 27, 2000 to Hashimoto et al discloses a fuel feed port sealing apparatus. A sealing member is provided in a fuel receiving tube. The fuel receiving tube is adapted to receive a fuel delivery nozzle. As the fuel nozzle enters the fuel receiving tube the sealing apparatus causes the feed port to decrease in inner diameter to securely fit around the fuel delivery nozzle.

U.S. Pat. No. 6,026,866 issued on Feb. 22, 2000 to Nanaji discloses an onboard vapor recovery detection nozzle. The invention includes a vapor recovery nozzle having a vapor passage in its nozzle spout and a vapor inlet in communication with the vapor passage. The spout includes a movable seal mounted on the spout. The seal moves from a first position to a second position to substantially block the passage of vapors through a vapor inlet.

U.S. Pat. No. 5,655,577 issued on Aug. 12, 1997 to Loen et al. and U.S. Pat. No. 5,609,192 issued on March 11 disclose a fuel dispenser. The fuel dispenser comprises a nozzle having a vapor recovery conduit, a fuel supply conduit, a sealing device for mating with a fuel tank inlet, an optical liquid sensor and a device to disenable fuel flow when a control signal is generated by the sensor.

U.S. Pat. No. 5,609,192 issued on Mar. 11, 1997 to Anderson et al. discloses a fuel dispenser. The fuel dispensing nozzle provides a sealing means that mates with a fuel tank inlet. The sealing means comprises a boot having an elastomeric sealing surface, a source of pressurized gas, a channel for communicating the pressurized gas to the outside of the boot and a means to block fuel flow through the fuel nozzle.

U.S. Pat. No. 4,898,395 issued on Feb. 6, 1990 to Kawase discloses a device for sealing a refueling opening. The sealing device has an elastic sealing member. The elastic member seals the gap between a fuel nozzle and a refueling pipe that the nozzle is inserted into.

U.S. Pat. No. 4,505,308 issued on Mar. 19, 1985 to Walker et al. discloses a sealing device for liquid dispensing nozzles that recover vapor having a conduit internal to a fill pipe. A sealing member that is capable elastic deformation provides a seal from the atmosphere between the mouth of a fill pipe and a liquid dispensing nozzle having a vapor recovery conduit means internal to the receptive fill pipe.

U.S. Pat. No. 3,990,490 issued on Nov. 9, 1976 to Voelz and U.S. Pat. No. 3,989,072 issued on Nov. 2, 1976 to Voelz et al. disclose a liquid dispensing nozzle assembly and sealing device. The sealing device includes a compressible cellular plastic material. When the discharge spout is inserted into a fill pipe the plastic material forms a vapor seal with the upper end of the fill pipe whereby the vapors escaping from the fill pipe are directed into an interior chamber.

U.S. Pat. No. 3,845,792 issued on Nov. 5, 1974 to Johnson discloses a fuel dispensing nozzle. The nozzle transfers fuel from a pressurized source to a vehicle fuel tank having a spout. The nozzle has a discharge tube for engaging the spout. An expandable material is carried on the discharge tube to be expanded when properly registered within the spout to form a seal.

U.S. Pat. No. 3,805,857 issued on Apr. 23, 1974 to Johnson et al. discloses a vaporizable fuel transfer system and seal thereof. The seal is an expandable bladder carried on a fuel dispensing nozzle. The bladder or seal is actuated by means of a valve communicated with an inflating medium and cooperative with a fuel flow control valve.

U.S. Pat. No. 3,566,928 issued on Mar. 2, 1971 to Hansel discloses a vapor seal for dispensing nozzles. The seal includes a plurality of flexible bellows that surround the nozzle to form a seal between the nozzle and a fill pipe that the nozzle is inserted into.

None of the above inventions and patents, taken either singly or in combination, is seen to describe the instant invention as claimed. Thus a locking fuel nozzle solving the aforementioned problems is desired.

SUMMARY OF THE INVENTION

The locking fuel nozzle is a positive locking, automatic shut-off fuel nozzle that is used to prevent spilling of fuel during filling of a vehicle fuel tank. The locking fuel nozzle is particularly designed for use with two inch fill tubes on railroad cars. The fuel nozzle is inserted into the fill tube of a fuel tank and is locked into place. When the fuel nozzle is locked into place a seal is created between the nozzle and the opening of the fill tube.

The nozzle comprises a nozzle tube that is secured to a pressurized fuel source. The nozzle tube is inserted into the opening of the fill tube and delivers fuel from the pressurized fuel source to the fuel tank. A compressible sealing member is disposed along the nozzle tube adjacent the end of the nozzle tube that is inserted into the fill tube. A compression member is slidably disposed along the nozzle for impacting the compressible sealing member. A handle is secured to the compression member for forcibly sliding the compression member along the nozzle tube.

The nozzle tube is inserted into the fill tube of a fuel tank so that the compressible sealing member is positioned inside of the fuel tube opening. When the handle is pulled backward the compression member is forced forward along the nozzle tube to impact the compressible sealing member. The compression member compresses the sealing member forcing it to swell. The sealing member swells until it completely seals the opening of the fill tube. The handle then locks the compression member in place and fueling is commenced. The locking fuel nozzle further includes an automatic shut-off valve that cuts off the fuel supply once the fuel tank is full.

Accordingly, it is a principal object of the invention to provide a locking fuel nozzle having a sealing member for creating a seal between the fuel nozzle and the fill tube of a fuel tank to prevent spilling of fuel.

It is another object of the invention to provide a locking fuel nozzle that is locked into place to maintain the seal created in the opening of the fill tube, and which may only be unlocked manually by the user of the nozzle.

It is a further object of the invention to provide a pressure sensitive fuel shut-off valve that cuts off the supply of fuel once the fuel tank is full.

Still another object of the invention is to provide a locking fuel nozzle that eliminates the need for screwing the nozzle onto a threaded portion of the fill tube to help prevent leaking.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
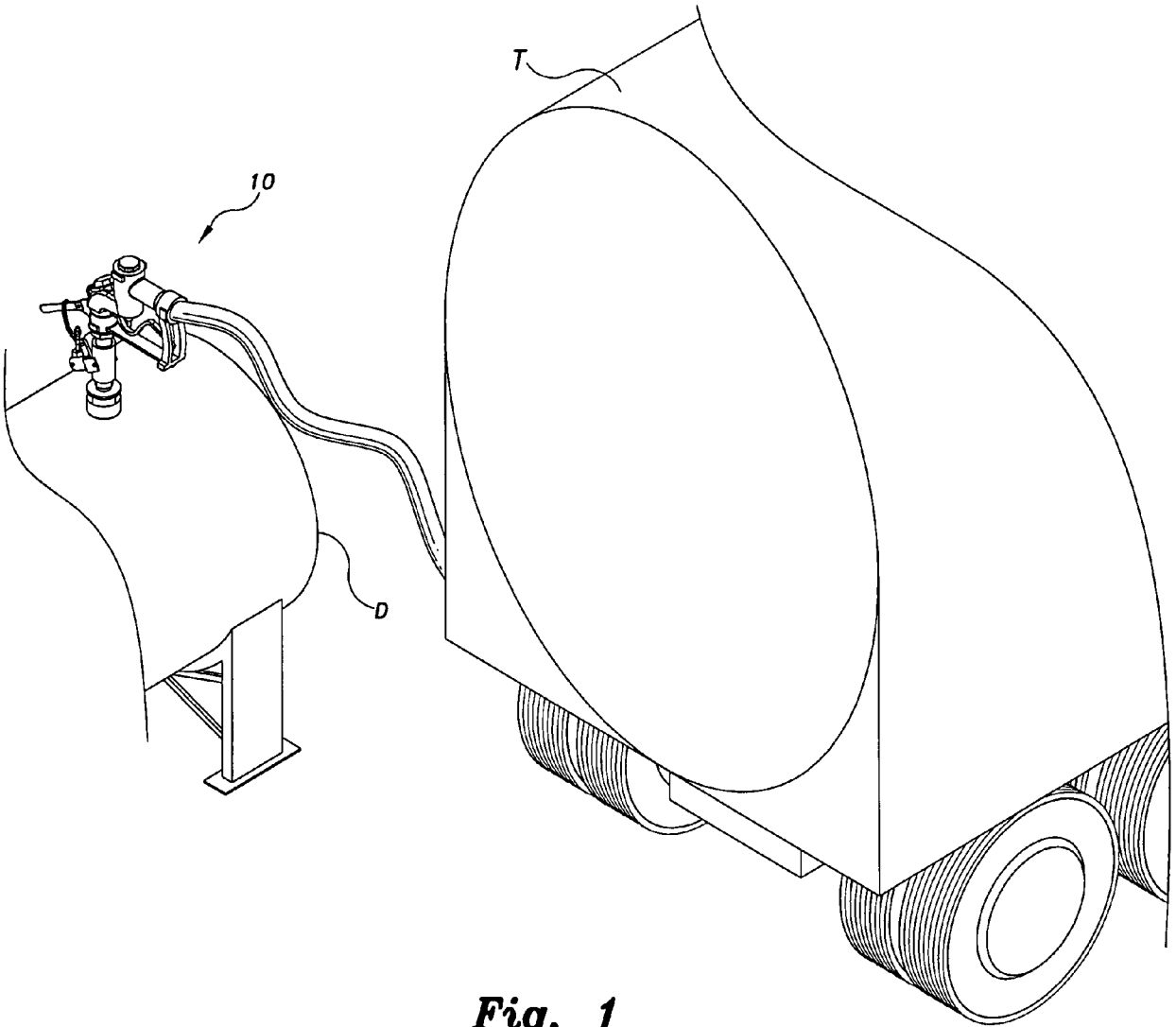
FIG. 1 is an environmental, perspective view of a locking fuel nozzle according to the present invention.

The present invention is a positive locking automatic shut-off fuel nozzle. The locking fuel nozzle is specifically designed for use with two inch fill tubes on railroad cars, but may also be used with any similar fuel tank for any type of vehicle. Also, the fuel nozzle 10 is intended for use with gasoline pumps but the nozzle 10 may be used with any volatile liquid delivery system. FIG. 1 is an environmental perspective view of the locking fuel nozzle 10. The locking fuel nozzle 10 is secured to a fuel tanker T at one end and is inserted into the fill tube of a fuel drum D (as shown in FIG. 1) at the other end. The fuel nozzle 10 delivers fuel from the fuel tanker T to the fuel drum D.

Figure 2:
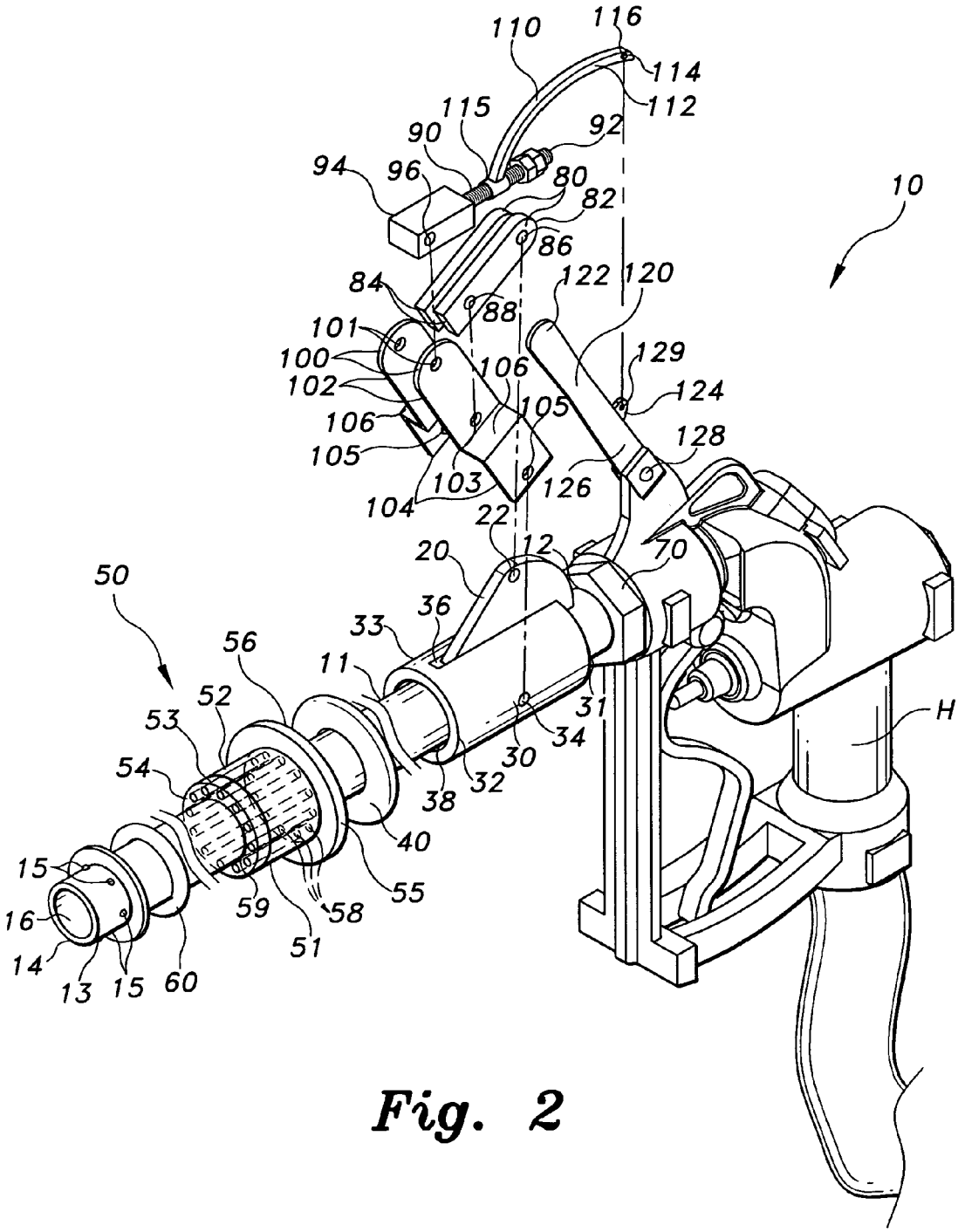
FIG. 2 is an exploded, side perspective view of the locking fuel nozzle.

FIG. 2 is an exploded perspective view of the locking fuel nozzle 10. The locking fuel nozzle 10 is secured to a pressurized fuel housing H. The locking fuel nozzle 10 comprises a nozzle tube 11, a mounting plate 20 disposed along the nozzle tube 11, a compression member 30, a compressible sealing member 50 and a handle 120.

The nozzle tube 11 has a secured end 12 and a fill tube engaging end 14. The secured end 12 is located adjacent the pressurized fuel housing H. The secured end 12 of the nozzle tube 11 is attached to the pressurized housing H by a threaded nozzle nutt 70 that screws onto a threaded projection of the housing H. The fill tube engaging end 14 has a circular opening 16. The fill tube engaging end 14 is inserted into the opening of a fill tube for a fuel drum D. A portion of the nozzle tube 11 extends into the fill tube to deliver fuel from the pressurized fuel source to the fuel drum D.

The compressible sealing member 50 is disposed along the nozzle tube 11 adjacent the fill tube engaging end 14. The compressible sealing member 50 has an impact end 56, an insertion end 54, a main body portion 51, an impact receiving portion 55 disposed along the impact end 56, a pressure absorbing portion 53 positioned adjacent the insertion end 54 and a center through hole 59. The sealing member 50 further comprises a plurality of hollow sections 58 that allow the sealing member 50 to ease the compression of the sealing member 50. The hollow sections 58 extend through the main body 51 from the impact receiving portion 55 to the pressure absorbing portion 53.

The main body 51 of the compressible sealing member 50 has an outer diameter 52. The outer diameter 52 of the main body 51 may vary depending on the size of the fill tube that the nozzle tube 11 is inserted into. In general, the outer diameter 52 of the main body 51 is between two and four inches. The center through hole 59 allows the sealing member 50 to be positioned along the nozzle tube 11. The center through hole 59 has an inner diameter that is substantially equivalent to the diameter of the nozzle tube 11. The inner diameter of the center through hole 59 is 1⅜ inches. The impact receiving portion 55 has a diameter that is slightly larger than that of the main body 51. In general, the diameter of the impact receiving portion 55 is between 2⅛ inches and 4⅛ inches so that it is ⅛ inches larger than the outer diameter 52 of the main body 51. The overall length, i.e. the space between the impact receiving portion 55 and the insertion end 54, of the main body 51 is between 1⅞ inches and 3⅞ inches. The above dimensions are provided as examples of possible designs of the sealing member 50, however the sealing member 50 is not limited to these dimensions.

The sealing member 50 is preferably made from rubber. The main body 51 of the sealing member 50 is made from a relaxed rubber that allows the main body 51 to be easily compressed. The impact receiving portion 55 and the pressure absorbing portion 53 of the sealing member 50 are made from a solid, rigid rubber that is resistant to compression.

The compression member 30 is slidably disposed along the nozzle tube 11. The compression member 30 comprises a first end 31, a second end 32, a cylindrical outer perimeter 33 and a center through hole 38. The compression member 30 further comprises a slot 36 disposed along its first end 31.

A mounting bracket 20 is slidably attached to the nozzle tube 11. The mounting bracket 20 engages the slot 36 disposed along the compression member 30. A fastener receiving hole 22 is disposed along the mounting bracket 20.

The handle 120 is pivotally secured to the fuel housing H. The handle 102 has an elongated, rod shaped body with a gripping portion 122 disposed at a top end of the handle 120. A mounting portion 126, located at the bottom end of the handle, is secured to the fuel housing H by a fastener 128, which is preferably a bolt. The handle 120 further comprises a side projection 124 having a through hole 129. The handle 120 is free to pivot about the fastener 128 to move from an unlocked forward position to a rearward locked position (shown in FIG. 3B).

A handle extension bar 110 is secured to the side projection 124 of the handle 120. The extension bar 110 has a curved main body 112 with an attachment end 114 and a slider end 113. The extension bar 110 is pivotally secured to the side projection 120 of the handle 120 by a fastener 116 on its attachment end 114 that engages the fastener receiving hole 129 on the handle 120. A threaded hole 115 is disposed along the slider portion 113 of the extension bar 110.

A compression member adjuster 90 is secured to the slider end 113 of the extension bar 110. The adjuster 90 has a generally rectangular main body 94 and an elongated threaded projection 92 that engages the threaded hole 115 of the extension bar 110. A fastener receiving hole 96 extends through the main body 94 of the adjuster 90.

The main body 94 of the adjuster 90 is secured between a pair of brackets 100. The brackets 100 each have a top portion 102, a bottom portion 104 and a spacer portion 106 disposed between the top portion 102 and the bottom portion 104. Each top portion 102 has a pair of fastener receiving holes 101, 103. The fastener receiving hole 96 on the adjuster 90 lines up with the top pair of fastener receiving holes 101 on the bracket. A fastener, particularly a bolt, engages the lined-up holes to secure the brackets 100 around the adjuster 90. The bottom portion 104 of the brackets 100 is secured on either side of the compression member 30 by a bolt 34 that extends through a bolt receiving hole 105 positioned on the bottom portion 104 of each bracket 100.

A pair of generally rectangular bolt plate 80 secure the brackets 100 to the mounting plate 20. The bolt plates 80 have a first end 82 that is secured to the mounting plate 20 and a second end 84 that is secured between the brackets 100. The bolt plates 80 have a pair of bolt receiving holes 86, 88. The bolt hole 86 receives a bolt that secures the bolt plates 80 to the mounting plate 20 by passing though the fastener receiving hole 22 on the mounting plate 20. The second end 84 of the bolt plates 80 are received between brackets 100 and a bolt extends through the bolt receiving holes 103 on the top portion of the brackets 100 and the bolt receiving hole 88 on the bolt plates 80.

The fuel nozzle 10 further comprises a crush ring 40 and a retaining ring 60 disposed along the nozzle tube 11 on either side of the sealing member 50. The crush ring 40 is disposed adjacent the impact end 56 of the sealing member 50 between the sealing member 50 and the compression member 30. The retaining ring 60 is disposed adjacent the insertion end 54 of the sealing member 50. The crush ring 40 serves to distribute the pressure from the compression member 30 evenly along the sealing member 50 and to protect the sealing member 50 from impact damage. The retaining ring 60 prevents the sealing member 50 from sliding along the nozzle tube 11 when impacted by the compression member 30.

The fuel nozzle 10 also comprises a plurality of retaining fasteners 15 disposed around the outer circumference of the nozzle tube 11. The retaining fasteners 15 are preferably brass fasteners 15, but any suitable fastener may be used. The retaining fasteners 15 further secure the sealing member 50 in place on the nozzle tube 11. The retaining fasteners 15 are easily removed to allow the sealing member 50 to be changed depending on the size of the fill tube. This feature allows a single fuel nozzle 10 to be used with varying sizes of fill tubes by removing the retaining fasteners 15 and changing the sealing member 50.

The locking fuel nozzle 10 further provides an automatic shut-off valve 13. The shut-off valve 13 is disposed along the nozzle tube 11 adjacent its fill tube engagement end 14. Once the fuel tank is full the pressure from the filling fuel reaches the shut-off valve 13. At this point the shut-off valve 13 terminates the flow of fuel from the pressurized fuel supply in the housing H.

Figure 3A:
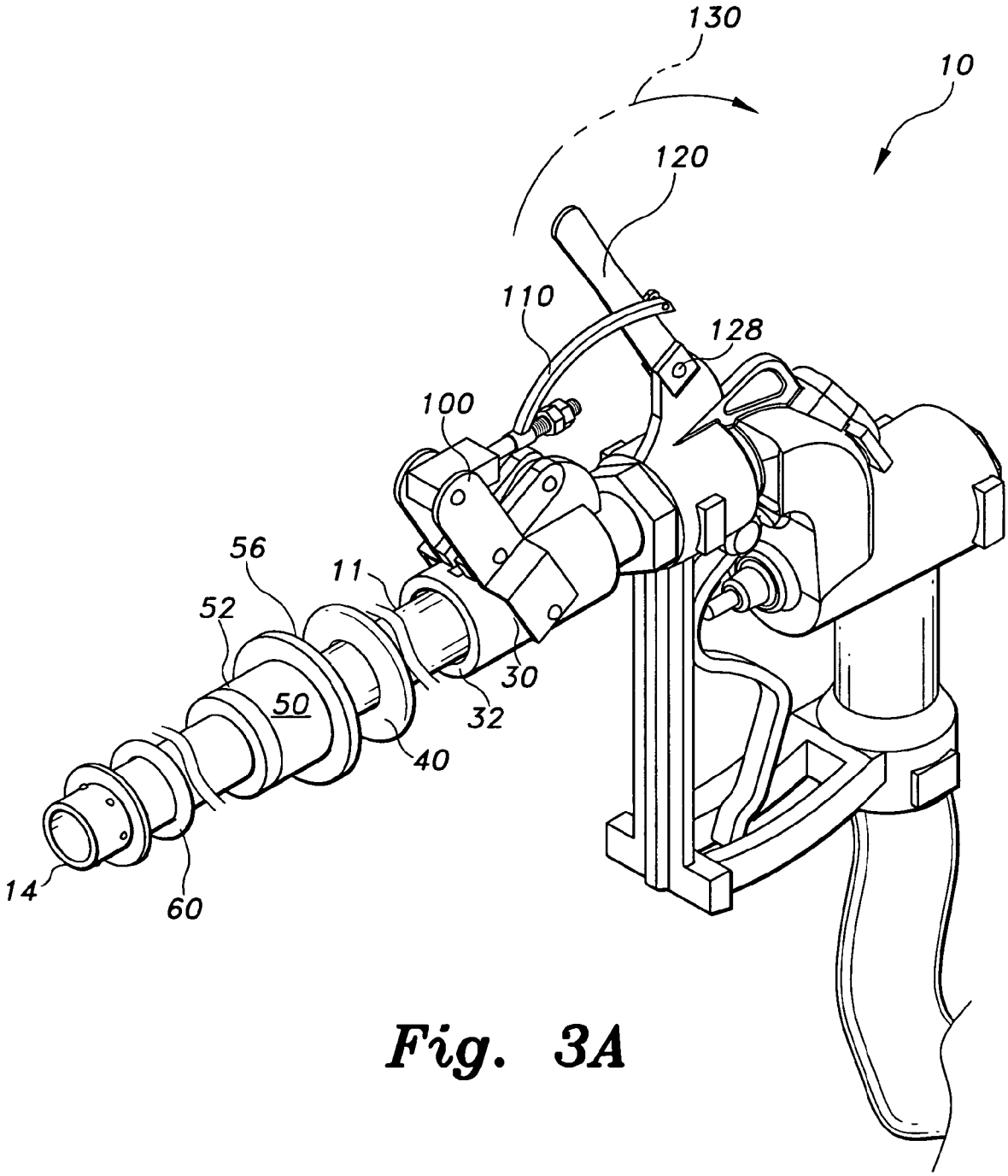
FIG. 3A is a side perspective view of the locking fuel nozzle in the unlocked position.
Figure 3B:
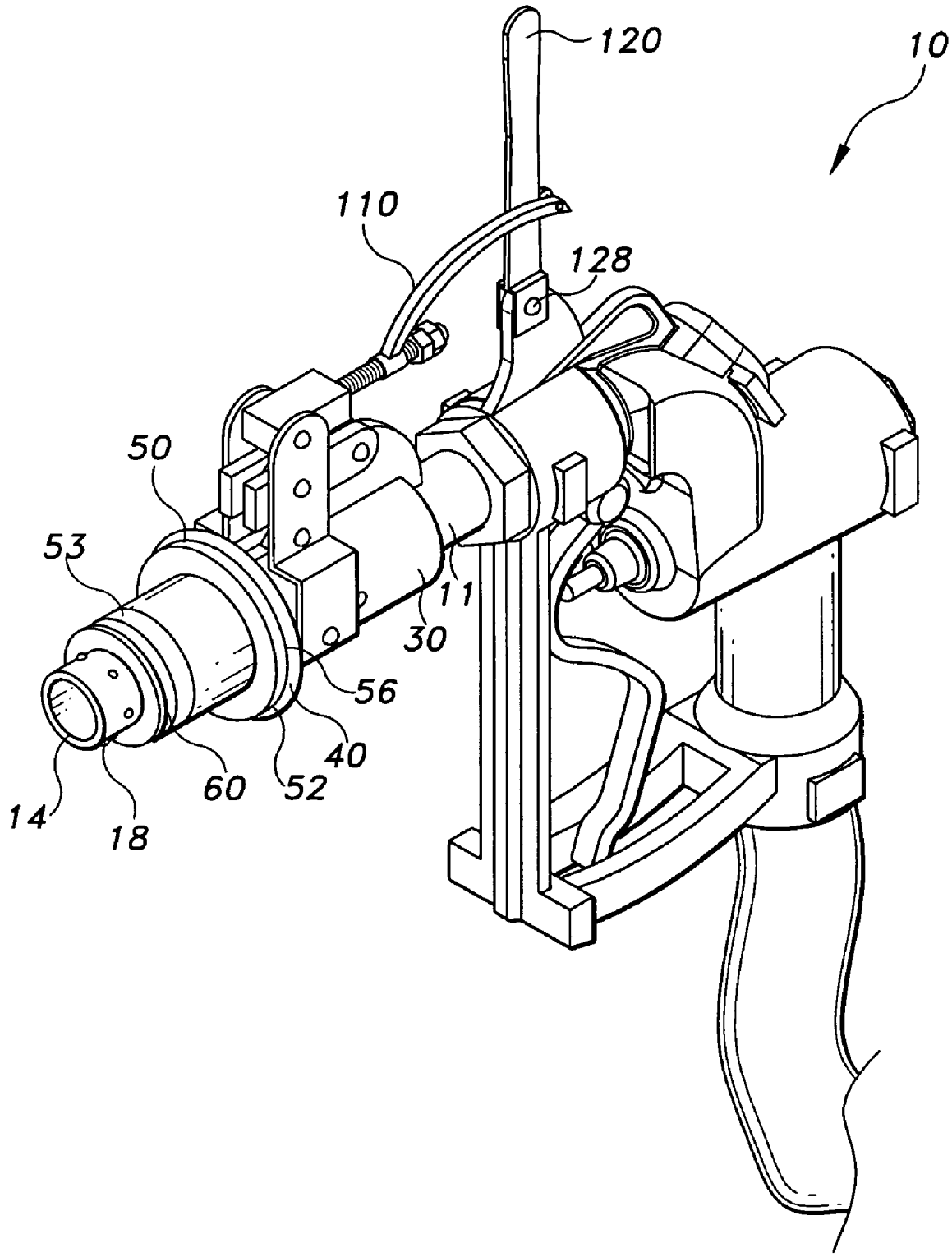
FIG. 3B is a side perspective view of the locking fuel nozzle in the locked position.

FIGS. 3A and 3B depict the functional aspects of the locking fuel nozzle 10. The locking fuel nozzle 10 creates a seal between the nozzle tube 11 and the fill tube that the nozzle tube 11 is inserted into. The seal is created by expanding or swelling the outer diameter 52 of the main body 51 of the sealing member 50. The outer diameter 52 is expanded to fill the open space between the nozzle tube 11 and the fill tube. FIG. 3A shows the sealing member 50 before its outer diameter 52 has been expanded. FIG. 3B depicts the sealing member 50 with its outer diameter expanded to create the seal.

The outer diameter 52 of the sealing member 50 is expanded by impacting the sealing member 50 with the compression member 30. To impact the sealing member 50 with the compression member the user of the nozzle 10 first inserts the nozzle tube 11 into a fill tube. Once inserted, the user forces the handle 120 backward. The direction that the handle 120 is moved is shown in FIG. 3A by arrow 130. As the handle 120 is moved backward the extension bar 110, which is secured to the compression member 30 by the brackets 100, forces the compression member 30 to slide along the nozzle tube 11. The adjuster 90 determines how far the compression member 30 slides along the nozzle tube 11. To make appropriate adjustments the threaded projection 92 of the adjuster 90 is tightened or loosened to change the length of the adjuster 90.

The second end 32 of the compression member 30 impacts the crush ring 40, which distributes the pressure from the compression member 30 evenly along the sealing member 50 so that the sealing member 50 is compressed uniformly. The pressure from the compression member 30 forces the relaxed rubber of the main body 51 of the sealing member 50 to compress. The hollow portions 58 inside of the main body 51 ease the compression. The impact receiving portion 55 and the pressure absorbing portion 53 of the sealing member 50 retain their original size and shape because they are made from the compression resistant, rigid rubber.

Once the sealing member 50 is completely compressed, as shown in FIG. 3B, the handle 120 is locked into place to prevent the compression member 30 from relieving its pressure against the sealing member 50. To release the seal created in the fill tube the handle 120 must be manually unlocked and returned to its original position.

It is to be understood that the present invention is not limited to the embodiment described above, but encompasses any and all embodiments within the scope of the following claims.

I claim:

1. A locking fuel nozzle, comprising:

an elongate, generally cylindrical nozzle tube having a first end secured to a pressurized fuel source, a second end adapted to be inserted into a fill tube of a fuel receptacle, and an opening at said second end for delivering fuel from the fuel source to the fuel receptacle;

a compressible sealing member disposed along said nozzle tube adjacent the opening at the second end of said nozzle tube;

a compression member slidably disposed along said nozzle tube for impacting and compressing said sealing member; and a handle pivotally mounted to said fuel source for causing said compression member to impact said sealing member;

whereby said sealing member creates a seal between the fill tube and said nozzle tube inserted therein to prevent fuel from spilling while delivering fuel to the fuel receptacle.

2. The locking fuel nozzle according to claim 1, further comprising a mounting plate disposed along said nozzle tube.

3. The locking fuel nozzle according to claim 1, further comprising a threaded nozzle nut for securing said nozzle tube to the pressurized fuel source.

4. The locking fuel nozzle according to claim 1, wherein said sealing member comprises an impact end, an insertion end, a main body portion having a outer diameter, an impact receiving portion disposed along said impact end, a pressure absorbing portion disposed along said insertion end and a center through hole for mounting said sealing member onto said nozzle tube.

5. The locking fuel nozzle according to claim 4, wherein said sealing member further comprises a plurality of hollow sections extending through said main body portion for easing the compression of the sealing member.

6. The locking fuel nozzle according to claim 4, wherein the main body of said sealing member is made from a flexible rubber.

7. The locking fuel nozzle according to claim 4, wherein the impact receiving portion and the pressure absorbing portion are made from a rigid rubber that is resistant to compression.

8. The locking fuel nozzle according to claim 1, wherein said compression member comprises a first end, a second end, a generally cylindrical outer perimeter, a center through hole for slidably mounting the compression member on said nozzle tube and a slot disposed along the first end.

9. The locking fuel nozzle according to claim 8, wherein said mounting plate slidably engages the slot in said compression member for urging said compression member into impacting engagement with said sealing member, said mounting plate having a fastener receiving hole extended through it.

10. The locking fuel nozzle according to claim 1, wherein said handle comprises an elongated, rod shaped body with a top end and a bottom end, a grip disposed on the top end of said handle, a mounting portion disposed at the bottom end of said handle, and a side projection having a through hole, whereby said handle is pivotally mounted to the fuel supply by a bolt and is free to move from an unlocked position to a locked position.

11. The locking fuel nozzle according to claim 10, further comprising an extension bar having a curved main body with a first end, a second end and a threaded hole extending through said second end, the first end of said extension bar being pivotally mounted to the side projection of said handle.

12. The locking fuel nozzle according to claim 11, further comprising a compression member adjuster for adjusting the amount of movement of the compression member, having a main body portion, an elongated threaded projection that engages the threaded hole of said extension bar, and a fastener receiving hole extending through the main body portion of said compression member adjuster.

13. The locking fuel nozzle according to claim 12, further comprising a pair of mounting brackets for securing the compression member adjuster to the compression member, each of said brackets having a top portion, a bottom portion, a spacer portion perpendicularly disposed between the top portion and the bottom portion and a plurality of through holes disposed along said brackets, whereby the bottom portion of said brackets is secured on either side of said compression member by a fastener extending through one of said through holes on each bracket and whereby said compression member adjuster is secured in between said brackets by a fastener that extends through the fastener receiving hole on the compression member adjuster and one of the through holes on each of said brackets.

14. The locking fuel nozzle according to claim 13, further comprising a bolt plate having a generally rectangular body with a first fastener hole and a second fastener hole each hole being adapted to receive a fastener, whereby said bolt plate secures said brackets to said mounting plate.

15. The locking fuel nozzle according to claim 1, further comprising a crush ring disposed along said nozzle tube between the sealing member and the compression member for distributing the impact force from the compression member evenly along the sealing member to uniformly compress the sealing member.

16. The locking fuel nozzle according to claim 1, further comprising a retaining ring disposed along said nozzle tube adjacent the opening on said nozzle tube for preventing the sealing member from sliding along said nozzle tube.

17. The locking fuel nozzle according to claim 1, further comprising a plurality of retaining fasteners disposed around the nozzle tube.

18. The locking fuel nozzle according to claim 1, further comprising an automatic shut off valve for cutting off the delivery of fuel from the fuel supply once the fuel tank is full.

* * * * *